United States Patent [19]

Rice

[11] 4,369,822

[45] Jan. 25, 1983

[54] COMBINATION TOOL CHEST DOLLY AND LEAVED WORKBENCH

[76] Inventor: Robert C. Rice, 6137 Lincoln Hwy., E., Fort Wayne, Ind. 46802

[21] Appl. No.: 207,395

[22] Filed: Nov. 17, 1980

[51] Int. Cl.[3] ..... B25H 1/00

[52] U.S. Cl. ..... 144/286 R; 108/80

[58] Field of Search ..... 108/80, 72; 248/129; 144/286 R, 287, 286 A

[56] References Cited

U.S. PATENT DOCUMENTS

| | | | |
|---|---|---|---|
| 10,285 | 11/1853 | Phelps | 108/82 |
| 27,026 | 1/1860 | Walker | 108/82 |
| 2,993,740 | 7/1961 | Good | 108/80 |

FOREIGN PATENT DOCUMENTS

| | | | |
|---|---|---|---|
| 2407013 | 2/1974 | Fed. Rep. of Germany | 144/286 R |
| 103876 | 2/1917 | United Kingdom | 144/286 R |

*Primary Examiner*—W. D. Bray

*Attorney, Agent, or Firm*—David A. Lundy

[57] ABSTRACT

A combination tool chest dolly and leaved workbench comprising a frame having generally parallel and spaced-apart first and second side members joined by a plurality of cross members and a plurality of support legs perpendicularly disposed from the frame. A plurality of casters are retractably mounted to the frame. The casters are movable between a first position thereof in which the frame is supported by the legs and a second position thereof in which the frame is supported by the casters. A plurality of generally parallel and spaced-apart stanchions having upper and lower ends are secured adjacent to the first and second side members at the lower ends thereof. At least one work surface leaf is swingably mounted between the upper ends of a pair of stanchions secured to the first and second side members, respectively, at the upper ends thereof. The leaf is movable between a first position thereof wherein the leaf lies in a generally vertical plane and a second position thereof wherein the leaf lies in a generally horizontal plane. At least one leaf prop having a frame end and a leaf end is pivotally mounted at the frame end thereof to the frame between the first and second side members. The prop is movable between a first position thereof wherein the leaf end adjoins the pair of stanchions and a second position thereof wherein the leaf end braces the leaf in its second position.

21 Claims, 7 Drawing Figures

COMBINATION TOOL CHEST DOLLY AND LEAVED WORKBENCH

BACKGROUND OF THE INVENTION

The subject matter of the invention relates to tool chest dollys and portable workbenches and more particularly to a combination tool chest dolly and leaved workbench for use with an upright cabinet type tool chest.

Mechanics, carpenters or other workmen whose trade requires the use of many and diverse types of hand tools or component parts must be afforded ready access to such tools or parts in the course of their trade. Moreover, these items in many cases must be brought to a given work site as the object of their efforts is often not amenable to removal to a workshop environment. However, to contain and transport such a large number of necessarily numerous and heavy items requires the utilization of a large tool chest or cabinet which itself is therefore unwieldy and only moved with great difficulty. Such chests themselves may therefore be provided with wheels or casters to facilitate movement to a work site but as much, the tool chest is therefore more prone to undesirable rolling about and instability when in use.

Additionally, another dilemma confronts the tradesman at the work site. Generally, a given work site affords little or no work surface suitable for repair or construction type work. It is therefore often necessary to remove items to a workshop environment for further repair or construction. Moreover, many work sites, by the small work area they provide, preclude the introduction and set up of a workbench at the site itself.

It is therefore highly desirable to provide a combination tool chest dolly and leaved workbench which facilitates the transportation of a large tool chest to a given work site.

It is also highly desirable to provide a combination tool chest dolly and leaved workbench which provides a stable platform for a tool chest at a given work site.

It is also highly desirable to provide a combination tool chest dolly and leaved workbench which is readily movable and maneuverable by an individual workman.

It is also highly desirable to provide a combination tool chest dolly and leaved workbench which provides one or more work surfaces at a given work site.

It is also highly desirable to provide a combination tool chest dolly and leaved workbench having one or more work surfaces which are collapsible for introduction into small work areas.

It is also highly desirable to provide a combination tool chest dolly and leaved workbench having one or more work surfaces which are readily detachable therefrom.

It is also highly desirable to provide a combination tool chest dolly and leaved workbench having one or more work surfaces which are expansible for subsequent setup and utilization at a given work site.

SUMMARY OF THE INVENTION

It is therefore an object of the invention to provide a combination tool chest dolly and leaved workbench which facilitates the transportation of a large tool chest to a given work site.

It is also an object of the invention to provide a combination tool chest dolly and leaved workbench which provides a stable platform for a tool chest at a given work site.

It is also an object of the invention to provide a combination tool chest dolly and leaved workbench which is readily movable and maneuverable by an individual workman.

It is also an object of the invention to provide a combination tool chest dolly and leaved workbench which provides one or more work surfaces at a given work site.

It is also an object of the invention to provide a combination tool chest dolly and leaved workbench having one or more work surfaces which are collapsible for introduction into small work areas.

It is also an object of the invention to provide a combination tool chest dolly and leaved workbench having one or more work surfaces which are readily detachable therefrom.

It is finally an object of the invention to provide a combination tool chest dolly and leaved workbench having one or more work surfaces which are expansible for subsequent setup and utilization at a given work site.

Briefly, what is provided is a combination tool chest dolly and leaved workbench comprising a frame having generally parallel and spaced-apart first and second side members joined by a plurality of cross members and a plurality of support legs perpendicularly disposed from the frame. A plurality of casters are retractably mounted to the frame. The casters are movable between a first position thereof in which the frame is supported by legs and a second position thereof in which the frame is supported by the casters. A plurality of generally parallel and spaced-apart stanchions having upper and lower ends are secured adjacent to the first and second side members at the lower ends thereof. At least one work surface leaf is swingably mounted between the upper ends of a pair of stanchions secured to the first and second side members, respectively, at the upper ends thereof. The leaf is movable between a first position thereof wherein the leaf lies in a generally vertical plane and a second position thereof wherein the leaf lies in a generally horizontal plane. At least one leaf prop having a frame end and a leaf end, is pivotally mounted at the frame end thereof to the frame between the first and second side members. The prop is movable between a first position thereof wherein the leaf end adjoins the pair of stanchions and a second position thereof wherein the leaf end braces the leaf in its second position.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein.

DESCRIPTION OF A SPECIFIC EMBODIMENT

Figure 1:
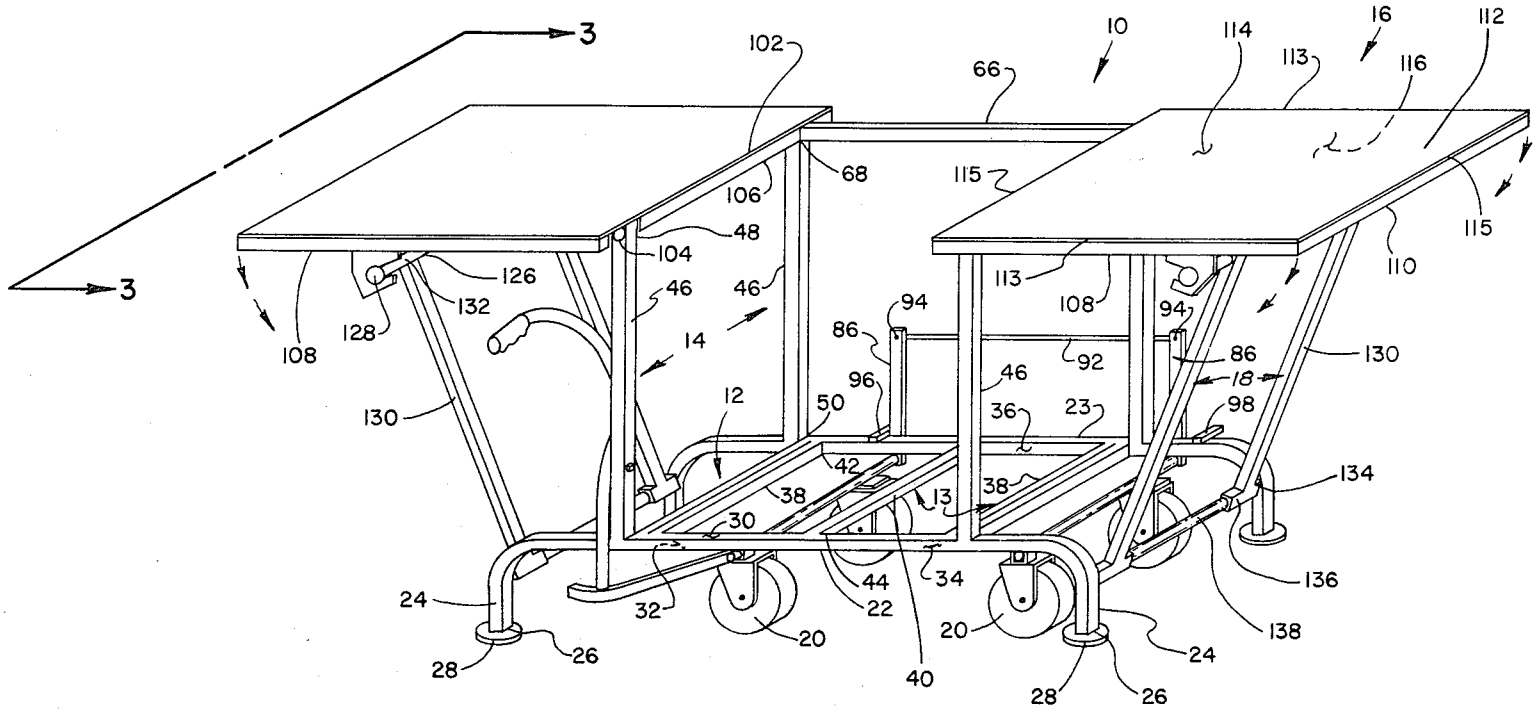
FIG. 1 is a perspective view of an embodiment of the invention illustrating the work surface leaves in an extended position.

Referring now to FIG. 1 the combination tool chest dolly and leaved workbench 10 is illustrated comprising a frame 12. Frame 12 is constructed of a plurality of cross members 13 interconnecting a first side member 22 and a second side member 23. In the embodiment illustrated, cross members 13 comprise a pair of generally parallel and spaced apart frame members 38 having a generally bar shaped configuration. Frame members 38 are attached at ends 42 thereof to first side member 22 and second side member 23 at their respective inner edges 36. Cross members 13 further comprise a generally bar shaped brace 40 attached at ends 44 thereof to first side member 22 and second side member 23 in a generally parallel and spaced-apart relation between frame members 38.

In the embodiment illustrated, first side member 22 and second side member 23 have arcuate bends at their ends 26 thereof forming legs 24. While legs 24 are formed in such a manner, it is obvious that they might be separate elements attached to first side member 22 and second side member 23 in any other conventional manner. At ends 26 are attached feet 28 providing a stable supporting surface on legs 24.

Figure 2:
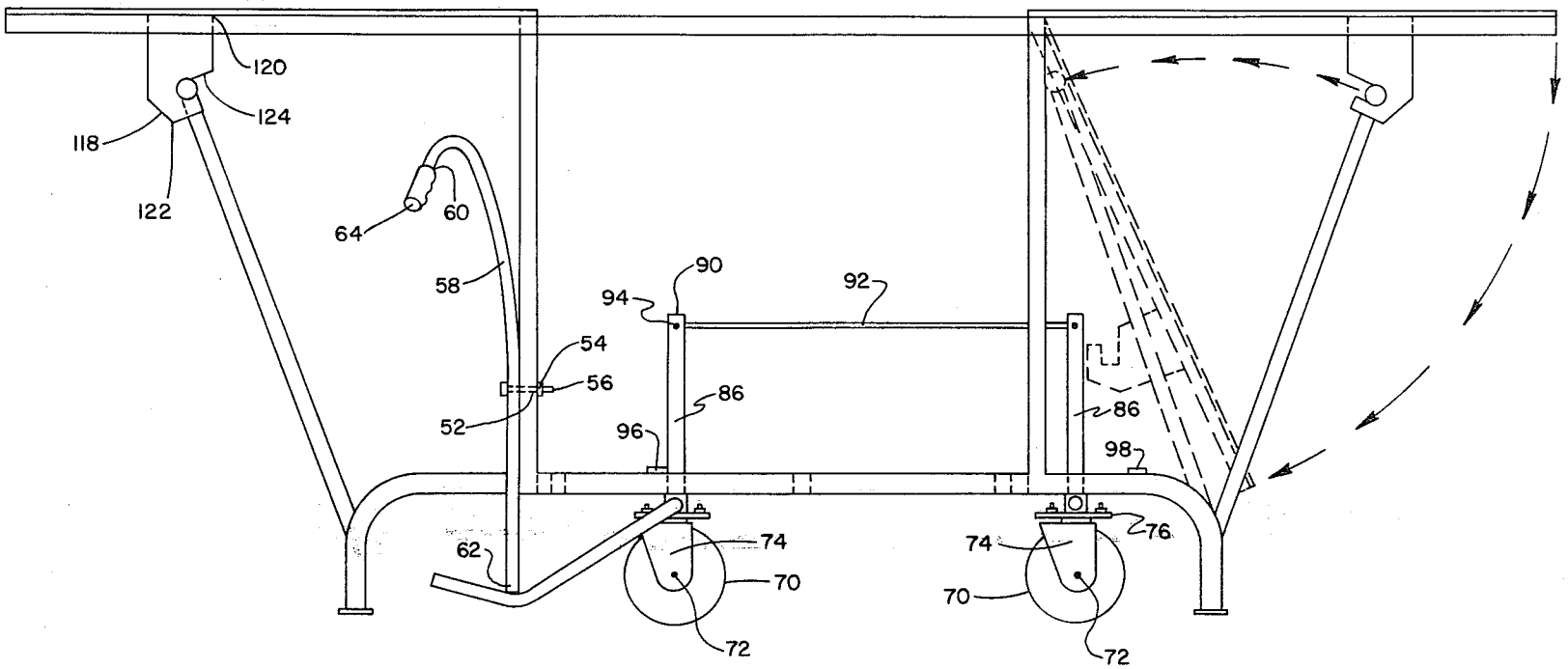
FIG. 2 is a side plan view of the embodiment shown in FIG. 1 illustrating one work surface leaf in an extended position and another work surface leaf in a retracted position.

Referring now to FIGS. 1 and 2, the stanchions 14 of the invention are shown. In the specific embodiment illustrated, stanchions 14 comprise a plurality of generally parallel and spaced-apart vertical posts 46 having upper ends 48 and opposite lower ends 50 thereof. Vertical posts 46 are secured to frame 12 at upper surface 30 adjacent ends 42 of frame members 38. In the specific embodiment illustrated, vertical posts 46 affixed to second side member 23 are interconnected at their upper ends 48 thereof by a cross bar 66 having opposite ends 68 secured to upper ends 48. Cross bar 66 provides further support to the pair of the stanchions 14. No cross bar 66 is provided between vertical posts 46 secured to first side member 22 to faciliate the installation, removal and utilization of a tool chest.

In a specific embodiment, frame 12, stanchions 14 and cross bar 66 are constructed of square structural steel stock, and cross members 13 first side member 22, second side member 23, stanchions 14 and cross bar 66 are interconnected utilizing conventional welding techniques. If desired, however, such elements may be constructed and interconnected in any other conventional manner.

Figure 4:
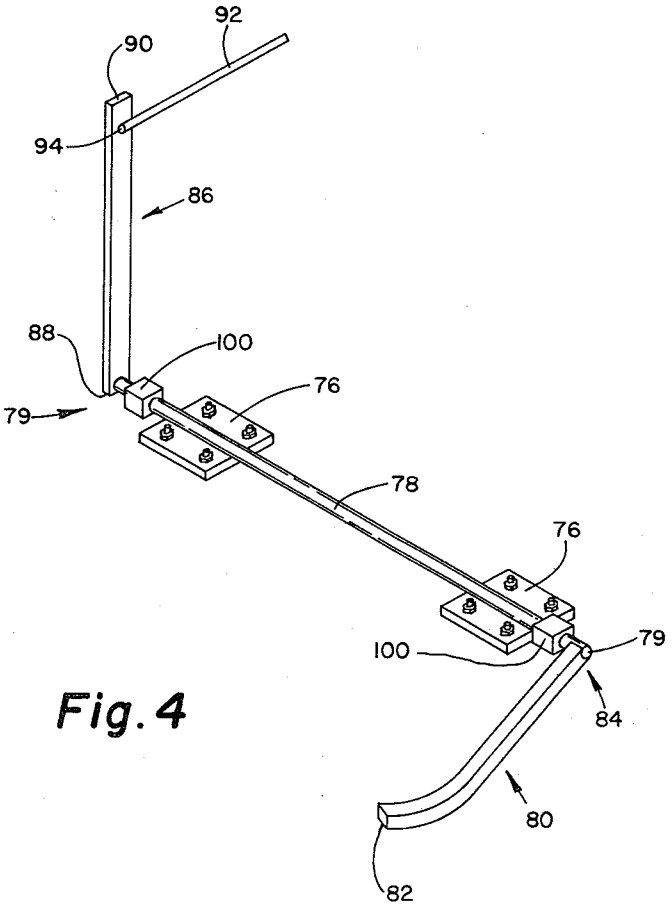
FIG. 4 is a partial perspective view of the caster extension and retraction mechanism in the embodiment shown in FIGS. 1 through 3.
Figure 3:
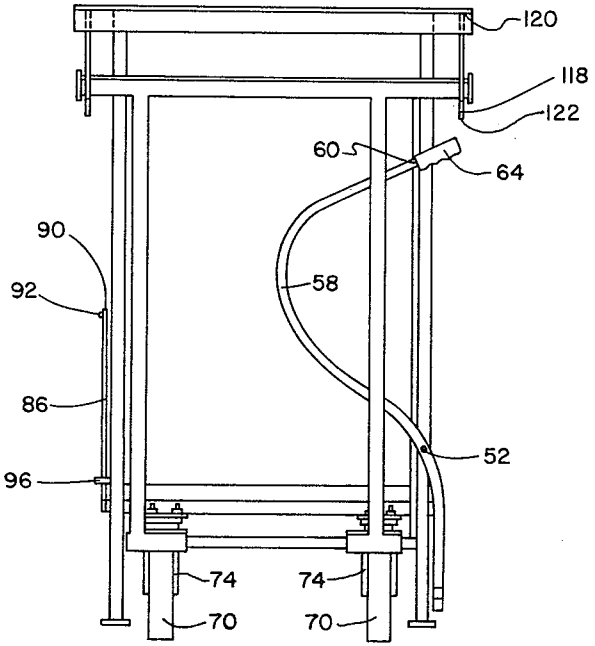
FIG. 3 is a side plan view of the embodiment of the invention taken substantially along line 3—3 of FIG. 2.

Referring now to FIGS. 1, 2 and 4 the casters 20 of the invention are illustrated. As shown, casters 20 comprise units having wheels 70 rotatably mounted about axles 72 held within yokes 74. Yokes 74 are rotatably mounted to caster pads 76 allowing the wheels 70 to pivot 360° about this point of interconnection.

In the specific embodiment shown, pads 76 are secured to a pair of caster axles 78 adjacent ends 79 thereof. Between caster pads 76 and ends 79 caster axles 78 pass through axle collars 100 allowing caster axles 78 to rotate within said axle collars 100. Axle collars 100 are secured to lower surfaces 32 of first side member 22 and second side member 23.

A wheel lever 80 comprising an arcuate shaped member having a free end 82 and an opposite axle end 84 is affixed at end 84 to one of ends 79 of one of the caster axles 78 adjacent outer edge 34 of first side member 22 of frame 12.

At ends 79 opposite wheel lever 80 of the pair of caster axles 78 are secured a pair of linkage members 86. Linkage members 86 comprise generally bar shaped members having connecting rod ends 90 and opposite axle ends 88. Linkage members 86 are securely affixed at ends 88 to ends 79 of caster axles 78 adjacent outer edge 34 of second side member 23 in a generally perpendicularly disposed relation to wheel lever 80 which is positioned adjacent outer edge 34 of first side member 22. Connecting rod ends 90 of linkage members 86 are pivotally interconnected by connecting rod 92 having opposite ends 94.

Lever arm 58 comprises a generally arcuate ansate member having an upper end 60 and an opposite lower end 62. Lever arm 58 is pivotally attached to a single one of vertical posts 46 secured to first side member 22 and adjacent to wheel lever 80. This pivotal attachment is effectuated by a bolt 56 extending through pivot holes 52 in lever arm 58 and the one of vertical posts 46 and is secured by means of nut 54. At upper end 60 of lever arm 58, a handle grip 64 may be conveniently provided to facilitate operation of lever arm 58. Should it be desired that casters 20 support the combination tool chest dolly and leaved workbench 10 for transportation thereof, wheel lever 80 is depressed and held downward by frictional engagement with lower end 62 of lever arm 58. Extension stop 96 is a generally rectangular element affixed to upper surface 30 of second side member 23. Extension stop 96 extends outward from second side member 23 to engage one of linkage members 86, which, acting with lever arm 58 keeps casters 20 fully extended.

Manually disengaging lower end 62 of lever arm 58 from wheel lever 80 allows casters 20 to retract upward placing the combination tool chest dolly and leaved workbench 10 on feet 28 of legs 24. A retraction stop 98 similar to construction to extension stop 96, is likewise affixed to upper surface 30 of second side member 23. Retraction stop 98 is so positioned so as to engage one of linkage members 86 so as to maintain wheel lever 80 in an easily accessible position for subsequent extension of casters 20.

In a specific embodiment, casters 20 may be conveniently provided from any commercially available units suitable for use in supporting the embodiment of the invention shown. Wheel lever 80, linkage members 86 and axle collars 100 may be conveniently provided from the same material described in conjunction with frame 12, stanchions 14 and cross bar 66 or hollow, square, structural steel members. Lever arm 58 may also be constructed of such material, however in the specific embodiment illustrated, lever arm 58 is constructed of round tubular steel or similar structural material. Caster axles 78 and connecting rod 90 are constructed utilizing conventional solid bar steel stock. Wheel lever 80 and linkage members 86 are securely affixed to caster axles 78 by means of conventional welding techniques. Extension stop 96 and retraction stop 98 are ordinary structural steel stock affixed by welding to second frame member 23.

Figure 5:
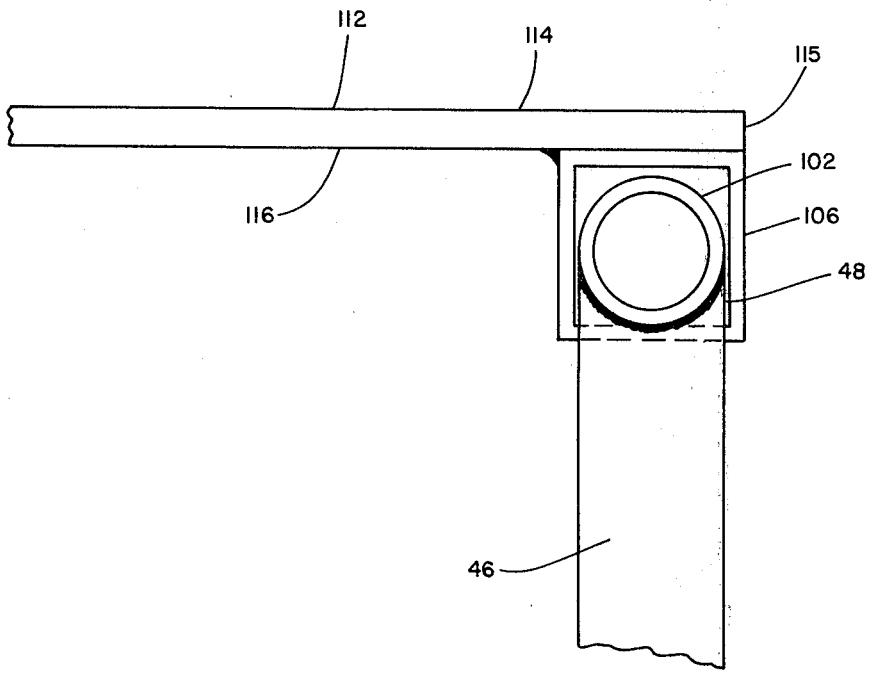
FIG. 5 is a partial cut-away detail view of the attachment of a work surface leaf in the embodiment shown in FIGS. 1 through 4.

Referring now to FIGS. 1, 2, and 5, the work surface leaves 16 of the invention are shown. Work surface leaves 16 comprise a pair of generally rectangular panels 112 having an upper surface 114 and opposite lower surface 116. Panels 112 are braced by means of respective pairs of side pieces 108 secured to the lower surface 116 of panels 112 adjacent the side edges 113 thereof. A single end piece 110 is likewise secured to lower surface 116 of panels 112 adjacent a single one of end edges 115 thereof. The remaining one of end edges 115 of panels 112 are rotatably mounted to leaf bars 102 extending between individual pairs of stanchions 14 affixed to first side member 22 and second side member 23 respectively. Leaf bars 102 are securely affixed at ends 104 thereof to upper ends 48 of vertical posts 46. Leaf bars 102 are circumferentially surrounded by respective sleeves 106 affixed to lower surfaces 116 of panels 112 affixed to each of end edges 115 opposite end pieces 110.

In a specific embodiment, side pieces 108, end pieces 110 and sleeves 106 are constructed of hollow rectangular structural steel stock. Leaf bars 102 are similarly constructed of hollow structural steel stock having a circular cross section. Panels 112 are constructed of heavy gauge sheet metal stock. And, side pieces 108, end pieces 110 and sleeves 106 are affixed to panels 112 utilizing conventional welding techniques. If desired, additional material may be affixed to upper surfaces 114 of panels 112 to provide alternative work surfaces.

Referring now to FIGS. 1, 2, and 4, the leaf props 18 of the invention are shown. Leaf props 10 comprise a pair of generally parallel and spaced-apart struts 130 having upper ends 132 and opposite lower ends 134. Leaf props 18 are rotatably connected between inner edges 36 of first side members 22 and second side member 23 adjacent legs 24 by means of prop rods 138 which extend between and are secured to first side member 22 and second side member 23. Struts 130 are secured at lower ends 134 thereof to sleeves 136 which circumferentially surround prop rods 138 adjacent legs 24 of frame 12.

Upper ends 132 of struts 130 are secured to latch bar 126 comprising a generally elongated shaped member having opposite ends 128 thereof. Latch bar 126 thus maintains struts 130 in a generally parallel and spaced-apart relation.

Affixed to lower surfaces 116 of panels 112 are respective pairs of latches 118. Latches 118 comprise members having panel ends 120 securely attached to lower surfaces 116 of panels 112 and opposite latch ends 122. Adjacent latch ends 122 of latches 118 are provided notches 124 facing toward stanchions 14. Notches 124 are constructed to engage latch bar 126 and latches 118 are affixed in positions to lower surface 116 such that notches 124 engage latch bar 126 adjacent ends 128 thereof when panels 112 are in their horizontal extended positions.

In a specific embodiment, struts 130 and sleeves 136 are constructed of the same materials utilized in frame 12. Likewise, prop rods 138 are constructed of the same structural material as leaf bars 102. Additionally, latch bar 126 is constructed from the same materials as lever arm 58. And, latches 118 are constructed of any suitable structural material such as steel which may therefore be welded to lower surfaces 116 of panels 112.

Dimensionally, stanchions 14 may be of sufficient height to allow the top of a tool chest supported by the frame 12 to provide a continuous surface between work surface leaves 16 and the tool chest top. In any event, the spacing between first side member 22 and second side member 23 as well as that between frame members 38 should approximately correspond to the external dimensions of a tool chest to provide optimum support therefore.

Figure 6:
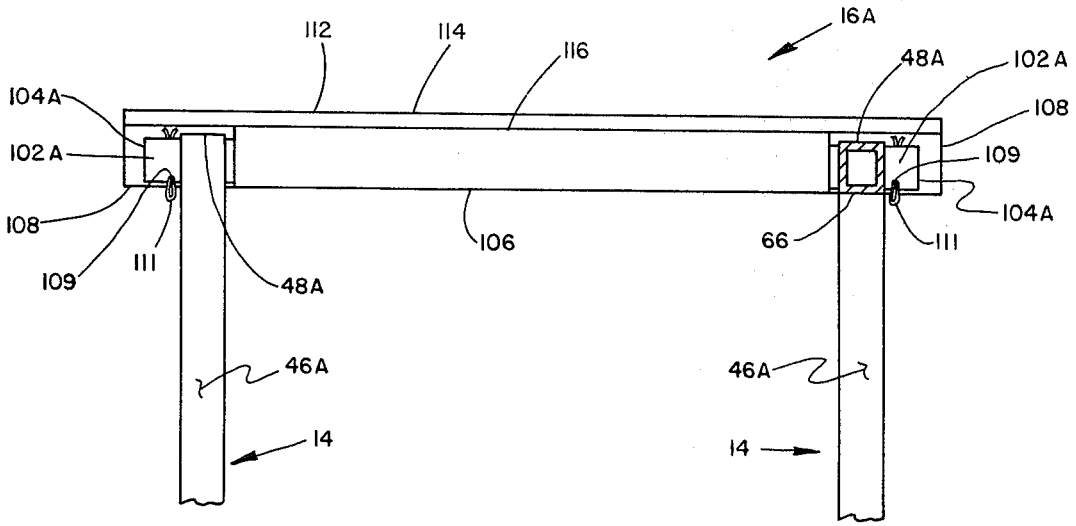
FIG. 6 is a partial side plan view of an alternative construction of the invention showing the connection of a detachable work surface leaf.

Referring now to FIG. 6 an alternative construction of the combination tool chest dolly and leaved workbench 10 is shown. Should it be desired, work surface leaves 16A may be made detachable. In this construction, panels 112 are affixed at lower surfaces 116 as previously specified to sleeves 106 which peripherally surround leaf bars 102A to allow free rotation of work surface leaves 16A about leaf bars 102A. Leaf bars 102A are rotatably held in the same manner as sleeves 106 by upper ends 48A of vertical posts 46A instead of welding or similar rigid attachment. Adjacent each of ends 104A of leaf bars 102A is provided single cotter pin holes 109 for insertion of cotter pins 111. When removed, cotter pins 111 allow leaf bars 102A to be manually removed from between vertical posts 46A thereby detaching work surface leaves 16A.

Figure 7:
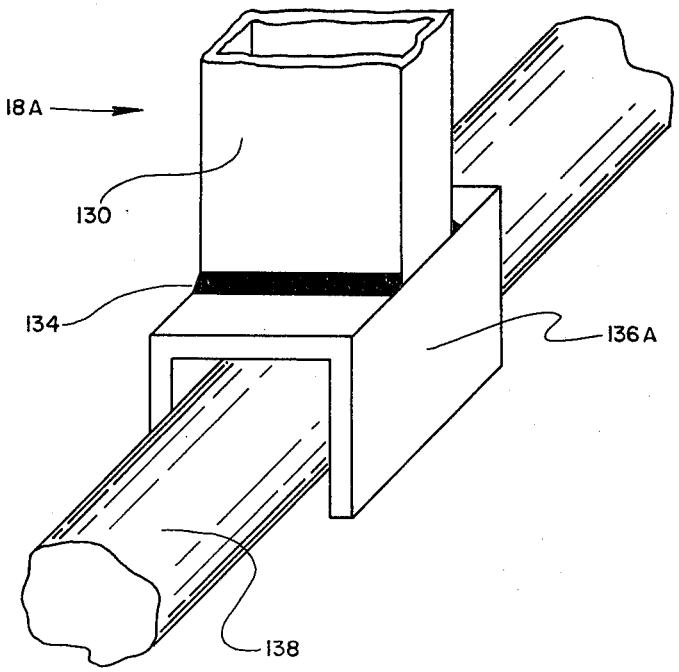
FIG. 7 is a partial perspective detail view of an alternative construction of the invention showing the rotational attachment of a detachable leaf prop for utilization with the construction shown in FIG. 6.

Referring now to FIG. 7 leaf props 18A are illustrated. Leaf props 18A can be detached from prop rods 138 when the function of leaf props 18A is obviated by the detachment of work surface leaves 16A as above described. Sleeves 136A are channelled structural elements having a generally "C" shaped cross-section rigidly affixed to lower ends 134 of struts 130. Gravitational forces the weight of work surface leaves 16A hold sleeves 136A to prop rods 138 to hold work surface leaves 16A in an extended position and to allow rotational movement there about. The channelled structure allows for the manual removal of leaf props 18A from the combination tool chest dolly and leaved workbench 10 when not needed.

In operation, a workman can readily move the combination tool chest dolly and leaved workbench 10 to a given work site by rolling it on casters 20. The combination tool chest dolly and leaved workbench 10 is caused to be supported on casters 20 by depressing wheel lever 80 at free end 82 thereof. This imparts rotational movement to the one of caster axles 78 to which wheel lever 80 is affixed. This one of caster axles 78, through linkage members 86 and connecting rod 92, imparts a similar rotational movement to the remaining one of the caster axles 78. In this manner, since legs 24 of frame 12 are shorter in length than the height of casters 20 in their extended position, depressing wheel lever 80 causes casters 20 to support frame 12. Allowing wheel lever 80 to move in an upward direction causes the retraction of casters 20 as affixed to caster axle 78 by pivoting in axle collars 100 allowing frame 12 to be supported by legs 24 and feet 26. Casters 20 may be held in an extended position by means of lever arm 58 and extension stop 96.

Work surface leaves 16 may be extended from the combination tool chest dolly and leaved workbench to provide a working surface at the work site. Work surface leaves 16 are free to rotate about leaf bars 102 such that work surface leaves 16 may be extended horizontally outward from stanchions 14 or folded vertically downward such that end pieces 110 adjoin legs 24 of frame 12. Struts 130 are free to pivot about prop rods 138 in much the same manner that work surface leaves 16 are free to rotate about leaf bars 102. Latch bar 126 serves to support work surface leaves 16 in a generally horizontal extended position. Manually disengaging latch bars 126 from latches 118 and pushing leaf props 18 towards stanchions 14 allows work surface leaves 16 to fold vertically downward such that end pieces 110 of panels 112 adjoin legs 24 of frame 12.

The combination tool chest dolly and leaved workbench 10 provides a stable platform for a tool chest and facilitates the transportation thereof to a given work site. The combination tool chest dolly and leaved workbench 10 of the invention is readily movable and maneuverable by an individual workman. The apparatus of the invention provides one or more work surfaces which are collapsible for introduction into small work areas and which are subsequently expansible for set up and utilization at a given work site. Work surface leaves 16A and leaf props 18A may also be made readily detachable for removal, if desired.

While there have been described above the principles of this invention in connection with specific apparatus, it is to be clearly understood that this description is made only by way of example and not as a limitation to the scope of the invention.

What is claimed is:

1. A combination tool chest dolly and leaved workbench comprising a frame having generally parallel and spaced apart first and second side members joined by a plurality of cross members, and a plurality of support legs generally perpendicularly depending from said side members, a plurality of casters movably mounted to said frame, said casters being movable between a first position thereof wherein said frame is supported by said legs and a second position thereof wherein said frame is supported by said casters, a plurality of generally vertically disposed, generally parallel and spaced apart stanchions having upper and lower ends, said stanchions being secured to said frame adjacent to said first and second side members at said lower ends thereof, at least one work surface leaf swingably mounted between said upper ends of a pair of said stanchions, said leaf being movable between a first position thereof wherein said leaf lies in a generally vertical plane and to a second position thereof wherein said leaf lies in a generally horizontal plane, at least one leaf prop having a frame end and a leaf end, said frame end thereof pivotally mounted to said frame, said prop being movable between a first position thereof wherein said leaf end adjoins said pair of stanchions and a second position thereof wherein said leaf end braces said leaf in said second position thereof.

2. The apparatus of claim 1 wherein said cross members are perpendicularly disposed to said side members.

3. The apparatus of claim 1 wherein said cross members and side members between said stanchions define the peripheral portions of a tool chest bottom support.

4. The apparatus of claim 3 further comprising a tool chest located between the stanchions supported by said side members and cross members.

5. The apparatus of claim 1 wherein said legs are formed by right arcuate bends in the end portions of said side members, and said legs further comprise a foot pad on each of said legs.

6. The apparatus of claim 1 wherein said casters are independently revolvable about a vertical axis.

7. The apparatus of claim 1 wherein said casters comprise forward and rear caster pairs retractably mounted to a forward and rear axle respectively, each of said caster pairs having a caster mounted adjacent said first side member and said second side member.

8. The apparatus of claim 7 wherein said forward and rear axles are rotatably interconnected by a connecting rod.

9. The apparatus of claim 8 wherein said casters are commonly distendable to said second position thereof by a lever affixed to said forward axle, said lever being movable between a first position thereof wherein said casters are in said first position thereof and a second position thereof wherein said casters are in said second position thereof.

10. The apparatus of claim 9 wherein said lever is frictionally held in said second position thereof by an arm pivotally mounted at one of said stanchions adjacent said lever.

11. The apparatus of claim 1 wherein said stanchions comprise forward and rear stanchion pairs having a stanchion of each of said stanchion pairs secured to said frame adjacent to each of said first and second side member ends.

12. The apparatus of claim 11 wherein said stanchion pairs generally define the external dimensions of a tool chest.

13. The apparatus of claim 1 wherein said upper ends of said stanchions secured to said second side member are rigidly interconnected by a perpendicularly disposed brace member.

14. The apparatus of claim 1 wherein said work surface leaf comprises a generally rectangular planar panel.

15. The apparatus of claim 11 wherein said work surface leaf is swingably mounted between said upper ends of said forward stanchion pair.

16. The apparatus of claim 15 further comprising a second work surface leaf swingably mounted between said upper ends of said rear stanchion pair.

17. The apparatus of claim 1 wherein said work surface leaf is rotatably mounted to a rod extending between said upper ends of said stanchions.

18. The apparatus of claim 1 wherein said leaf prop comprises a pair of generally parallel and spaced apart members having said frame ends thereof pivotally mounted to said frame and said leaf ends thereof rigidly interconnected by a latching bar.

19. The apparatus of claim 18 wherein said latching bar engages a latch secured to said leaf.

20. The apparatus of claim 1 wherein said work surface leaf is detachably mounted between said upper ends of a pair of said stanchions.

21. The apparatus of claim 20 wherein said leaf prop is detachably mounted at said frame end thereof.

* * * * *